US005385293A

United States Patent [19]

Hirota et al.

[11] Patent Number: 5,385,293

[45] Date of Patent: Jan. 31, 1995

[54] CORRUGATED FIBERBOARD BOX FOR PACKAGING LARGE TELEVISION RECEIVER

[75] Inventors: Narumi Hirota, Ibaraki; Toshiharu Hikida, Kyoto; Ryuzo Kurita, Osaka; Toshihide Inada, Ibaragi, all of Japan

[73] Assignee: Matsushita Electric Industrial Co., Ltd., Osaka, Japan

[21] Appl. No.: 80,095

[22] PCT Filed: Sep. 2, 1991

[86] PCT No.: PCT/JP91/01169

§ 371 Date: Apr. 21, 1992

§ 102(e) Date: Apr. 21, 1992

[87] PCT Pub. No.: WO92/04240

PCT Pub. Date: Mar. 19, 1992

Related U.S. Application Data

[63] Continuation of Ser. No. 847,997, Apr. 21, 1992, abandoned.

[30] Foreign Application Priority Data

Sep. 3, 1990 [JP] Japan ..... 2-230587

[51] Int. Cl.[6] ..... B65D 88/58

[52] U.S. Cl. ..... 229/122; 206/320; 229/23 R

[58] Field of Search ..... 229/122, 123, 23 R; 206/319, 320, 326, 335

[56] References Cited

U.S. PATENT DOCUMENTS

| | | | |
|---|---|---|---|
| 2,180,691 | 11/1939 | Olivier | 229/122 |
| 2,301,310 | 11/1942 | Messer | 229/122 |
| 2,648,480 | 8/1953 | Belsinger | 229/122 |
| 2,671,601 | 3/1954 | Leavitt | 229/122 |
| 2,797,039 | 6/1957 | Belsinger | 229/122 |
| 3,262,631 | 7/1966 | Belsinger | 229/122 |
| 3,891,137 | 6/1975 | Ellison et al. | 229/122 |
| 4,658,298 | 4/1987 | Takada et al. | 206/320 |
| 5,011,021 | 4/1991 | Coltrane et al. | 229/123 |

FOREIGN PATENT DOCUMENTS

| | | |
|---|---|---|
| 2313659 | 10/1974 | Germany . |
| 54-26267 | 8/1979 | Japan . |
| 55-13210 | 3/1980 | Japan . |
| 60-129317 | 8/1985 | Japan . |
| 1080421 | 8/1967 | United Kingdom . |

OTHER PUBLICATIONS

Patent Abstracts of Japan, vol. 2, No. 101 (E-78) 19 Aug. 1978 & JP-A-53 Δ214 (Mitsubishi Denki K.K.) 13 Jun. 1978.

*Primary Examiner*—Gary E. Elkins

*Attorney, Agent, or Firm*—Stevens, Davis, Miller & Mosher

[57] ABSTRACT

A corrugated fiberboard box (1) for packaging a large television receiver which includes openable and closable surfaces provided on a top surface (3) and one of the side surfaces (2) thereof. When a large television receiver (4) is to be taken out of the packaging corrugated fiberboard box (1), the receiver can be taken out through the openable and closable side-surface portion (2).

5 Claims, 2 Drawing Sheets

CORRUGATED FIBERBOARD BOX FOR PACKAGING LARGE TELEVISION RECEIVER

This application is a continuation of application Ser. No. 847,997, filed Apr. 21, 1992 (abandoned).

TECHNICAL FIELD

The present invention relates to a corrugated fiberboard box for packaging a large television receiver.

BACKGROUND ART

FIGS. 3 and 4 show a conventional corrugated fiberboard box for packaging a large television receiver. Referring to FIGS. 3 and 4, reference numeral 5 denotes a large television receiver-packaging corrugated fiberboard box; 5-1, an upper case; and 5-2, a lower case. Reference numeral 6 denotes a large television receiver.

It is necessary for a corrugated fiberboard box for packaging a large television to be so constructed as to be able to cope with the great weight of a large television receiver 6. Hitherto, a certain structure which can be divided into upper and lower sections, has been adopted in the large television receiver-packaging corrugated fiberboard box 5 so that, when the upper case 5-1 is removed, the large television receiver 6 can be easily taken out of the box.

However, the adoption of a structure dividable into upper and lower sections, such as above, entails a drawback in that it is necessary to use an additional joining member for joining the upper case 5-1 and the lower case 5-2 together. There is another drawback, a poor producibility.

The present invention is intended to eliminate the conventionally-entailed drawbacks, and is aimed to provide a corrugated fiberboard box for packaging a large television receiver which, without having a structure dividable into upper and lower sections, enables an unpackaging or packaging operation to be performed with good efficiency.

DISCLOSURE OF THE INVENTION

In order to achieve the above object, according to the present invention, there is provided a corrugated fiberboard box for packaging a large television receiver, the box having certain portions of a side surface and a top surface thereof which are openable and closable so that, when the large television receiver is to be taken out of the box, the receiver can be taken out through an opened side-surface portion.

The above arrangement assures that, though the corrugated fiberboard box for packaging a large television receiver of a great weight does not have a structure divisable into upper and lower sections, the efficiency of an operation of taking out the receiver is not deteriorated, and that the packaging corrugated fiberboard box has a good producibility.

BEST MODE FOR CARRYING OUT THE INVENTION

Figure 1:
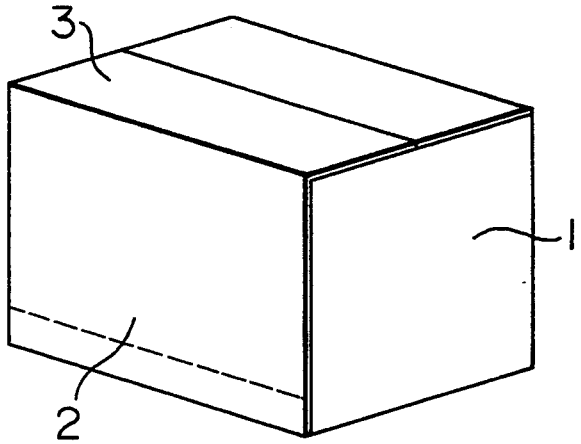
FIG. 1 is a perspective view showing a condition of a large television receiver-packaging corrugated fiberboard box according to an embodiment of the present invention where both a side surface and a top surface of the box, each of which is openable and closable, are closed.
Figure 2:
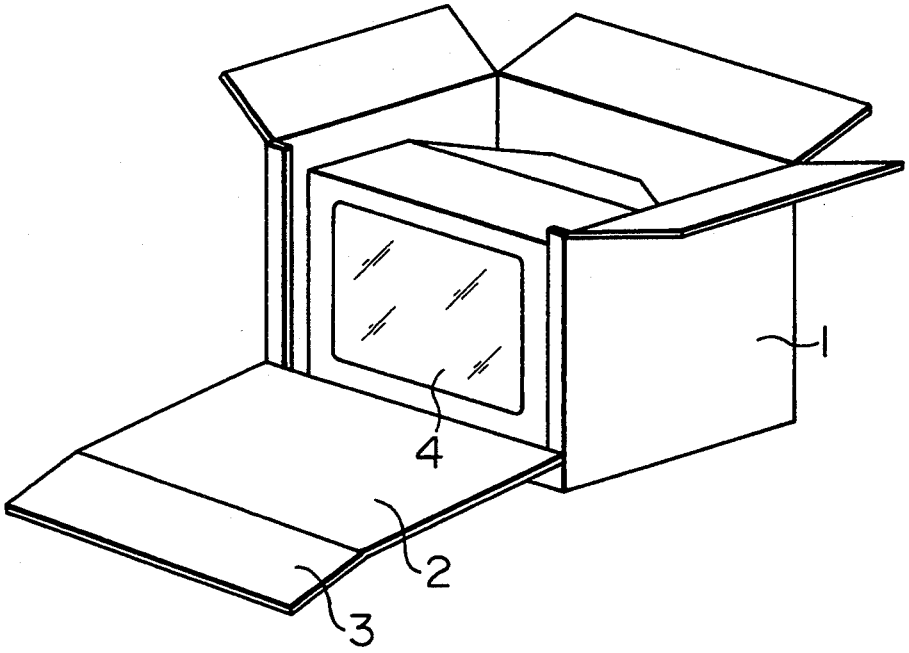
FIG. 2 is a perspective view of a condition of the embodiment of the present invention where both the side surface and the top surface, each of which is openable and closable, are opened.
Figure 3:
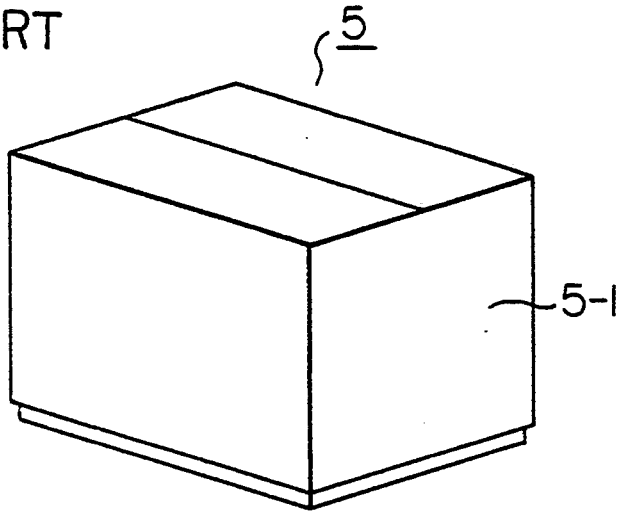
FIG. 3 PRIOR ART
FIG. 3 is a perspective view showing a closed condition of a conventional large television receiver-packaging corrugated fiberboard box having a structure dividable into upper and lower sections.
Figure 4:
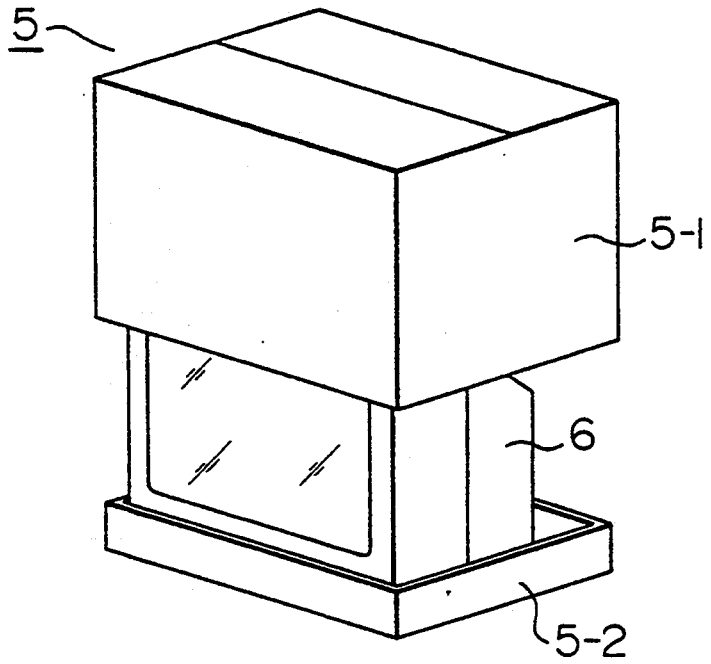
FIG. 4 PRIOR ART
FIG. 4 is a perspective view showing an opened condition of the conventional large television receiver-packaging corrugated fiberboard box having a structure dividable into upper and lower sections.

FIG. 1 is a perspective view showing a condition of a large television receiver-packaging corrugated fiberboard box according to an embodiment of the present invention where a side surface and a top surface of the box, which have portions rendered openable and closable, are closed. FIG. 2 is a perspective view showing a condition of the embodiment of the present invention where the side surface and the top surface are opened. Referring to FIGS. 1 and 2, reference numeral 1 denotes a large television receiver-packaging corrugated fiberboard box; 2, a side-surface portion which can be opened and closed; and 3, a top-surface portion which can be opened and closed. Reference numeral 4 denotes a large television receiver. The openable and closable side-surface portion 2 has dimensions which, in an opened position, facilitates the operation of taking the large television receiver 4 out of the box 1.

The large television receiver-packaging corrugated fiberboard box 1 having the above construction will be described further in detail. When, as shown in FIG. 1, the openable and closable side-surface portion 2 and the openable and closable top-surface portion 3 are brought into their closed positions, the large-television receiver-packaging corrugated fiberboard box 1 is in a condition enabling transportation after factory shipment. Thereafter, when, as shown in FIG. 2, the openable and closable side-surface portion 2 and the openable and closable top-surface portion 3 are brought into their opened positions, the box is in a condition enabling the large television receiver 4 to be easily taken out.

INDUSTRIAL APPLICABILITY

As is apparent from the foregoing embodiment, the present invention has an advantage in that, without adopting a structure dividable into upper and lower sections in a corrugated fiberboard box for packaging a large television receiver of a great weight, it is possible to realize a packaging corrugated fiberboard box which does not deteriorate the efficiency of a taking-out operation, and which has an excellent producibility.

LIST OF REFERENCE NUMERALS IN THE DRAWINGS 1, 5. large television receiver-packaging corrugated fiberboard box
2. openable and closable side-surface portion
3. openable and closable top-surface portion
4, 6. large television receiver
5-1. upper case
5-2. lower case

What is claimed is:

1. A box for packaging a product, said box being generally in the form of a rectangular parallelepiped, said box comprising:

a top wall, a bottom wall and side walls;

a pair of longitudinally extending flaps forming lateral parts of a first one of said side walls and integrally connected to second and third ones of the side walls through first and second continuous seamless edge lines, a width of said flaps being so determined as to allow said product packaged in the box to be taken out from the box through a space between said flaps; and an openable and closable wall forming a part of said first one of said side walls and closing said space between said flaps, said openable and closable wall also forming a part of said top wall;

said openable and closable wall having a first foldable line which constitutes an edge line connecting said first one of said side walls and said part of said top wall, and a second foldable line extending substantially parallel to a third continuous seamless edge line through which said first one of said side walls and said bottom wall are integrally connected, said second foldable line being spaced a small distance from said third continuous seamless edge line, said openable and closable wall having a portion located between said second foldable line and said third continuous seamless edge line and secured to said flaps.

2. A box as in claim 1, wherein said openable and closable wall comprises a hinge for fixing said part of said top wall formed by said openable and closable wall to said part of said first one of said side walls formed by said openable and closable wall along said first foldable line.

3. A box as in claim 2, wherein said hinge is formed integrally in said openable and closable wall.

4. A box as in claim 1, wherein said box is formed of corrugated board.

5. A box as in claim 1, wherein said top wall further comprises a pair of top flaps extending from said second and third ones of said side walls.

* * * * *

UNITED STATES PATENT AND TRADEMARK OFFICE

CERTIFICATE OF CORRECTION

PATENT NO. : 5,385,293

DATED : January 31, 1995

INVENTOR(S) : Narumi HIROTA, et al

It is certified that error appears in the above-indentified patent and that said Letters Patent is hereby corrected as shown below:

Title page, item [73], change "Matsushita Electric Industrial Co., Ltd., Osaka, Japan" to —Matsushita Electric Industrial Co., Ltd., Osaka and Chiyoda Shikogyo Kabushiki Kaisha, Sashima-gun, both of Japan—.

Signed and Sealed this

Fourth Day of June, 1996

*Attest:*

Bruce Lehman

BRUCE LEHMAN

*Attesting Officer*

*Commissioner of Patents and Trademarks*